US009098060B2

(12) United States Patent
Watanabe et al.

(10) Patent No.: US 9,098,060 B2
(45) Date of Patent: Aug. 4, 2015

(54) CLEANING DEVICE, PROCESS CARTRIDGE, AND IMAGE FORMING APPARATUS

(71) Applicant: CANON KABUSHIKI KAISHA, Tokyo (JP)

(72) Inventors: Yousuke Watanabe, Yokohama (JP); Masao Uyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/189,890

(22) Filed: Feb. 25, 2014

(65) Prior Publication Data

US 2014/0241772 A1 Aug. 28, 2014

(30) Foreign Application Priority Data

Feb. 28, 2013 (JP) ..... 2013-039528

(51) Int. Cl.
*G03G 21/00* (2006.01)
*G03G 21/18* (2006.01)

(52) U.S. Cl.
CPC ..... *G03G 21/18* (2013.01); *G03G 21/0029* (2013.01)

(58) Field of Classification Search
USPC ..... 399/107, 111, 123, 343, 350, 351, 399/358–360
See application file for complete search history.

(56) References Cited

U.S. PATENT DOCUMENTS 5,470,635 A 11/1995 Shirai
5,602,623 A * 2/1997 Nishibata et al. ..... 399/111
5,991,568 A * 11/1999 Ziegelmuller et al. ..... 399/102

* cited by examiner

*Primary Examiner* — Hoan Tran
(74) *Attorney, Agent, or Firm* — Canon USA Inc. IP Division

(57) ABSTRACT

A cleaning device includes a cleaning member for removing a developer from a surface of a member to be cleaned and the cleaning member includes a blade portion, and a flexible plate-like supporting member configured to support the blade portion, the supporting member including one end portion, in which the blade portion is provided, the other end portion, which has a portion to be fixed to a frame member, a bent portion, which is positioned between the one end portion and a side plate portion projecting from a side end of the one end portion, and a sealing member, which is provided between the cleaning member and the frame member, configured to prevent the developer from leaking from a storage chamber and fixed to one of the side plate portion and the frame member.

33 Claims, 9 Drawing Sheets

CLEANING DEVICE, PROCESS CARTRIDGE, AND IMAGE FORMING APPARATUS

BACKGROUND OF THE INVENTION

1. Field of the Invention

The present invention relates to a cleaning device, a process cartridge, and an image forming apparatus.

2. Description of the Related Art

In an electrophotographic image forming apparatus, a cleaning blade method using a cleaning unit has been known for removing developer remaining on an image bearing member (a member to be cleaned) after a developer image formed on the image bearing member has been transferred onto a recording medium to repeatedly use the image bearing member.

The cleaning blade method is a method for removing developer from a surface of the image bearing member by contacting a blade having elasticity with the surface of the image bearing member at a predetermined pressure.

In United States Patent Publication Application No. 5470635, a cleaning member has a configuration in which a blade is attached to a tip end of a sheet metal serving as a supporting member by shape forming. The cleaning member is fixed by attaching the sheet metal to a frame member with a screw or the like, to bring the cleaning member into contact with a surface of an image bearing member at a predetermined pressure.

An image forming apparatus such as a printer tends to be reduced in size, increased in speed, and enhanced in image quality as it spreads. With the reduction of the image forming apparatus in size, the size of an image bearing member is to be reduced. The image bearing member rotates fast when the image forming apparatus is to be increased in speed. More specifically, a blade, which contacts a surface of the image bearing member, slides on the surface of the image bearing member repeatedly at high speed. The temperature of the blade itself rises, so that the hardness of the blade is lowered. As a result, the friction force between the surface of the image bearing member and the blade rises. Thus, a driving torque for driving the image bearing member may increase, and the blade may warp. Further, developer with a spherical shape may have recently been used to enhance the image quality. In this case, a contact pressure of the blade on the image bearing member needs to be increased to remove the developer from the surface of the image bearing member, which is one of factors for confounding the above-mentioned problem.

SUMMARY OF THE INVENTION

The present invention is directed to a technique for improving stability of a contact pressure of a blade portion on a member to be cleaned.

According to an aspect of the present invention, a cleaning device for an image forming apparatus includes (i) a frame member, (ii) a cleaning member for removing a developer from a surface of a member to be cleaned. The cleaning member includes a blade portion configure to come into contact with the member to be cleaned in a direction counter to a moving direction of the member to be cleaned, and a flexible plate-like supporting member configured to support the blade portion, the supporting member including one end portion, in which the blade portion is provided, the other end portion, which has a portion to be fixed to the frame member, a bent portion, which is positioned between the one end portion and the other end portion and positioned outwardly away from the surface of the member to be cleaned with respect to a line segment connecting the portion to be fixed and a contact portion, in which the blade portion comes into contact with the member to be cleaned, and a side plate portion projecting from a side end of the one end portion, wherein the portion to be fixed is arranged on the downstream side of the moving direction of the member to be cleaned to the contact portion, (iii) a storage member, which includes the frame member, configured to store the developer removed by the cleaning member, and (iv) a sealing member, which is provided between the cleaning member and the frame member, configured to prevent the developer from leaking from the storage member and fixed to one of the side plate portion and the frame member.

According to another aspect of the present invention, a process cartridge attachable to and detachable from an image forming apparatus, the process cartridge includes (i) a photosensitive member, (ii) a frame member, (iii) a cleaning member for removing a developer from a surface of the photosensitive member. The cleaning member includes a blade portion configured to come into contact with the photosensitive member in a direction counter to a moving direction of the photosensitive member, and a flexible plate-like supporting member configured to support the blade portion, the supporting member including one end portion, in which the blade portion is provided, the other end portion, which has a portion to be fixed to the frame member, a bent portion, which is positioned between the one end portion and the other end portion and positioned outwardly away from the surface of the photosensitive member with respect to a line segment connecting the portion to be fixed and a contact portion, in which the blade portion comes into contact with the photosensitive member, and a side plate portion projecting from a side end of the one end portion, wherein the portion to be fixed is arranged on the downstream side of the moving direction of the photosensitive member to the contact portion, (iv) a storage chamber, which includes the frame member, configured to store the developer removed by the cleaning member, and (v) a sealing member, which is provided between the cleaning member and the frame member, configured to prevent the developer from leaking from the storage chamber and fixed to one of the side plate portion and the frame member.

According to yet another aspect of the present invention, an image forming apparatus for forming an image on a recording medium, the image forming apparatus includes (i) a member to be cleaned, (ii) a frame member, (iii) a cleaning member for removing a developer from a surface of a member to be cleaned. The cleaning member includes a blade portion configured to come into contact with the member to be cleaned in a direction counter to a moving direction of the member to be cleaned, and a flexible plate-like supporting member having configured to support the blade portion, the supporting member including one end portion, in which the blade portion is provided, the other end portion, which has a portion to be fixed to the frame member, a bent portion, which is positioned between the one end portion and the other end portion and positioned outwardly away from the surface of the member to be cleaned with respect to a line segment connecting the portion to be fixed and a contact portion, in which the blade portion comes into contact with the member to be cleaned, and a side plate portion projecting from a side end of the one end portion, wherein the portion to be fixed is arranged on the downstream side of the moving direction of the member to be cleaned to the contact portion, (iv) a storage chamber, which includes the frame member, configured to store the developer removed by the cleaning member, and (v) a sealing member, which is provided between the cleaning member and the frame member, configured to prevent the developer from leaking from the storage chamber and fixed to one of the side plate portion and the frame member.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

The size, the material, and the shape of each of components and their relative arrangement described in the following exemplary embodiments may be changed, as needed, depending on a configuration of an apparatus to which the present invention is applied and various conditions, and do not intend to restrict the scope of the present invention to the following exemplary embodiments.

An image forming apparatus to which the present invention is applicable includes an electrophotographic copying machine, a laser beam printer, a light emitting diode (LED) printer, and a facsimile apparatus. A process cartridge refers to the one that is integrally formed at least including an image bearing member and a cleaning device as a cartridge and is attachable and detachable to and from the image forming apparatus.

An example of an image forming apparatus according to a first exemplary embodiment will be described below.

Figure 5:
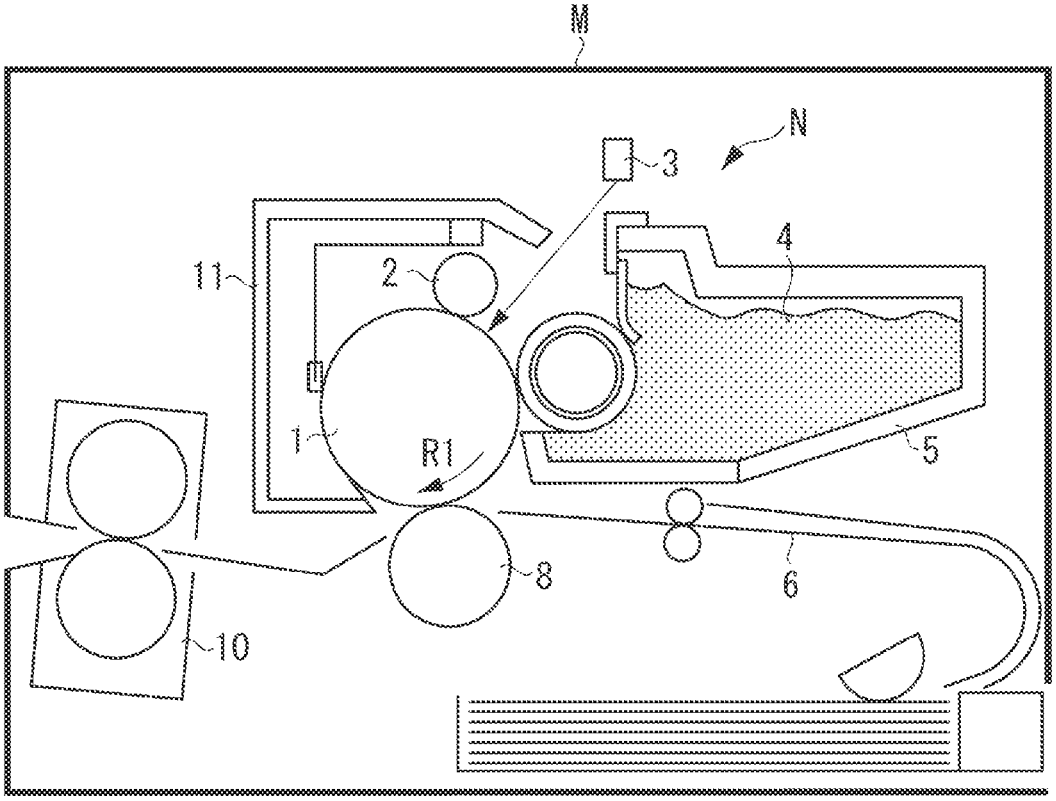
FIG. 5 is a cross-sectional view illustrating a schematic configuration of an image forming apparatus according to the first exemplary embodiment.

FIG. 5 is a vertical sectional view illustrating a schematic configuration of the image forming apparatus according to the present exemplary embodiment. FIG. 5 illustrates an electrophotographic image forming apparatus.

A drum type photosensitive member (hereinafter referred to as a photosensitive drum) 1 serving as an image bearing member (a member to be cleaned) is disposed substantially at the center of an image forming apparatus body (hereinafter referred to as an apparatus body) M. The photosensitive drum 1 has an organic photo conductor (OPC) photosensitive layer formed on an outer peripheral surface of its conductive drum base made of aluminum, and is driven to rotate around a rotation axis (axis) at a predetermined process speed (peripheral speed) of 200 mm/s in a direction of an arrow R1 illustrated in FIG. 5. The direction of the arrow R1 is a rotation direction (movement direction) of the photosensitive drum 1.

A surface (peripheral surface) of the photosensitive drum 1 is uniformly charged to a predetermined polarity and potential by a charging roller 2 serving as a charging unit. The surface of the photosensitive drum 1 after the charging is subjected to scanning exposure with a laser beam. The laser beam is output from a laser beam scanner 3 serving as an exposure unit and modulated to correspond to a time series electric digital pixel signal of target image information, and an electrostatic latent image corresponding to the target image information is formed on the surface of the photosensitive drum 1. The electrostatic latent image is developed as a toner image (a developer image or a developed image) when supplied with toner 4 serving as a developer by a development device 5 serving as a development unit.

On the other hand, a recording material (recording medium) 6 is fed by a feeding roller, and is sent to a transfer nip portion between the photosensitive drum 1 and a transfer roller 8 so as to be synchronized with the toner image formed onto the photosensitive drum 1. With the arrangement, the toner image is transferred onto a surface of the recording material 6. A transfer bias for transfer is applied to the transfer roller 8 from a transfer bias apply power source during transfer.

The recording material 6, on which the toner image has been transferred, is separated from the surface of the photosensitive drum 1 and is conveyed to a fixing device 10 serving as a fixing unit. In the fixing device 10, the recording material 6 is heated and pressurized so that the toner image is fixed to its surface.

On the other hand, after the toner image has been transferred onto the recording material 6, the toner 4 remaining on the surface of the photosensitive drum 1 without being transferred onto the recording material 6 is removed by a cleaning device 11 serving as a cleaning unit, and the photosensitive drum 1 is prepared for the subsequent image formation.

In the image forming apparatus according to the present exemplary embodiment, a process cartridge (a process unit or a cartridge) N includes four process devices, which are the photosensitive drum 1, the charging roller 2, the development device 5, and the cleaning device 11, incorporated into its cartridge container. The process cartridge N is configured to be attachable to and detachable from the apparatus body M.

Figure 2:
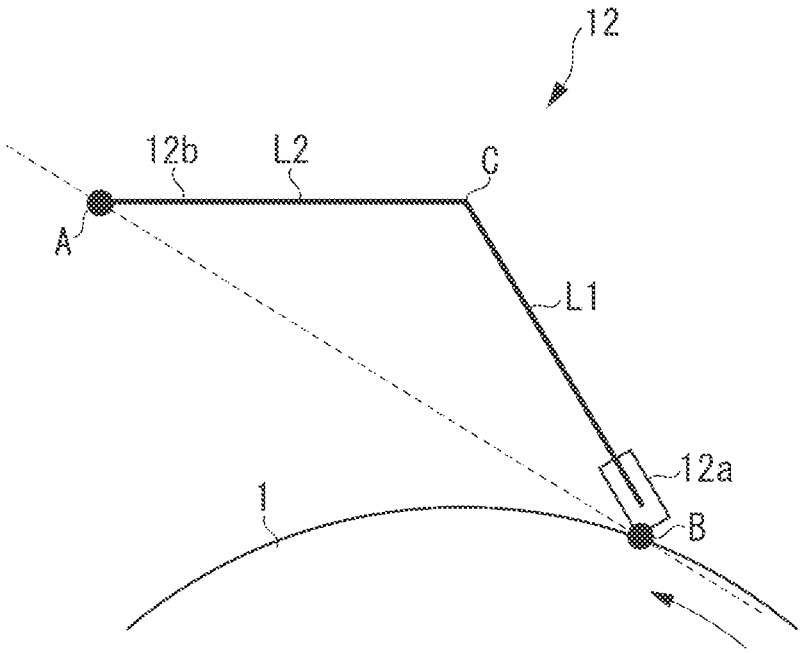
FIG. 2 is a schematic view for illustrating a cleaning blade in the first exemplary embodiment.
Figure 6:
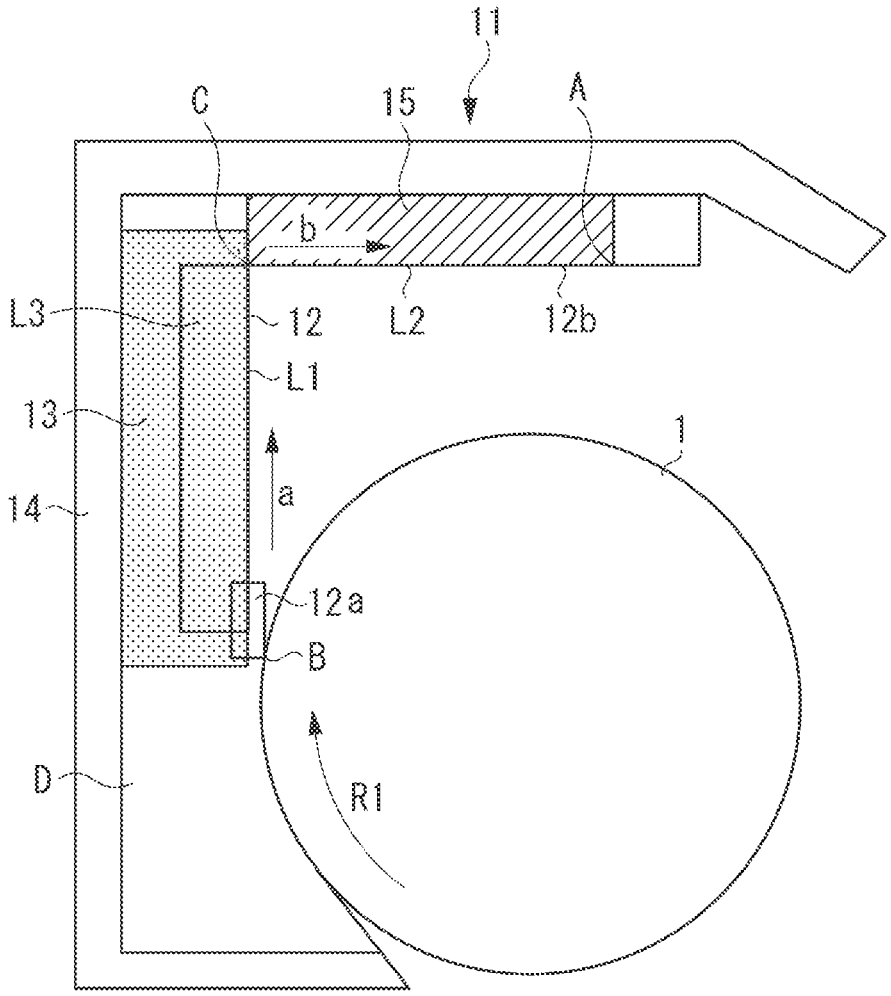
FIG. 6 is a cross-sectional view illustrating a schematic configuration of the main part of the cleaning device according to the first exemplary embodiment.

FIG. 6 is a cross-sectional view illustrating a schematic configuration of a main part of the cleaning device 11 according to the present exemplary embodiment. FIG. 2 is a schematic view illustrating a cleaning blade 12 serving as a cleaning member in the present exemplary embodiment.

The cleaning device 11 includes the cleaning blade 12, sealing members 13 and 15, and a housing 14. In the cleaning device 11, the cleaning blade 12 and the housing 14 form a waste toner chamber (storage chamber) D for storing toner removed from the surface of the photosensitive drum 1 by the cleaning blade 12. The cleaning device 11 is provided with a sealing structure for sealing between the cleaning blade 12 and the housing 14 to prevent the toner from leaking from the waste toner chamber D. The sealing structure includes the sealing members 13 and 15. In FIG. 6, the sealing members 13 and 15 are hatched for convenience of illustration.

The cleaning blade 12, which is a characteristic component of the present exemplary embodiment, includes a plate-shaped supporting member 12*b* having flexibility, and a blade portion 12*a* formed of a rubber member at one end (a tip end or a free end) of the supporting member 12*b*. The blade portion 12*a* comes into contact with the photosensitive drum 1 in a counter direction with respect to a movement direction of the photosensitive drum 1 (a direction of the arrow R1 illustrated in FIG. 6). The cleaning blade 12 is disposed so that the other end of the supporting member 12*b* is fixed to the housing 14 at a fixed portion (a portion to be fixed) A, and the blade portion 12*a* comes into contact with the photosensitive drum 1 at a contact portion B. Residual transfer toner on the photosensitive drum 1, which has been scraped off by the blade portion 12*a*, is recovered (stored) in the waste toner chamber D.

The supporting member 12*b* is subjected to bending work so that a bent portion (folded portion) C is uniformly formed along a rotation axis direction of the photosensitive drum 1 between the blade portion 12*a* and the fixed portion A.

In the present exemplary embodiment, a portion of the supporting member 12*b* from the bent portion C to the blade portion 12*a* on the side of the tip end is one end portion L1. A portion of the supporting member 12*b* from the fixed portion A to the bent portion C is the other end portion L2, as illustrated in FIG. 6. The sealing member 13 seals between the one end portion L1 and the housing 14, and the sealing member 15 seals between the other end portion L2 and the housing 14.

As illustrated in FIG. 2, the bent portion C is on a side opposite to the photosensitive drum 1 with respect to a line segment AB connecting the fixed portion A and the contact portion B in the present exemplary embodiment. More specifically, the bent portion C is positioned on a side apart outward from the surface of the photosensitive drum 1 (on a side away from the surface of the photosensitive drum 1). The supporting member 12*b* is arranged so that the fixed portion A is positioned on the downstream side of the contact portion B in the movement direction of the photosensitive drum 1. The blade portion 12*a* is supported by only one end of the supporting member 12*b* (a tip end of the one end portion L1). The other end portion L2 has flexibility with respect to displacement of the one end portion L1 in a direction indicated by an arrow a illustrated in FIG. 6.

With such a configuration, the one end portion L1 receives a force from the blade portion 12*a*, to elastically deform the other end portion L2. If the blade portion 12*a* is pushed in due to an increase in friction with the photosensitive drum 1 when the photosensitive drum 1 moves from its stationary state, the bent portion C is movable in a direction away from the surface of the photosensitive drum 1.

Figure 3:
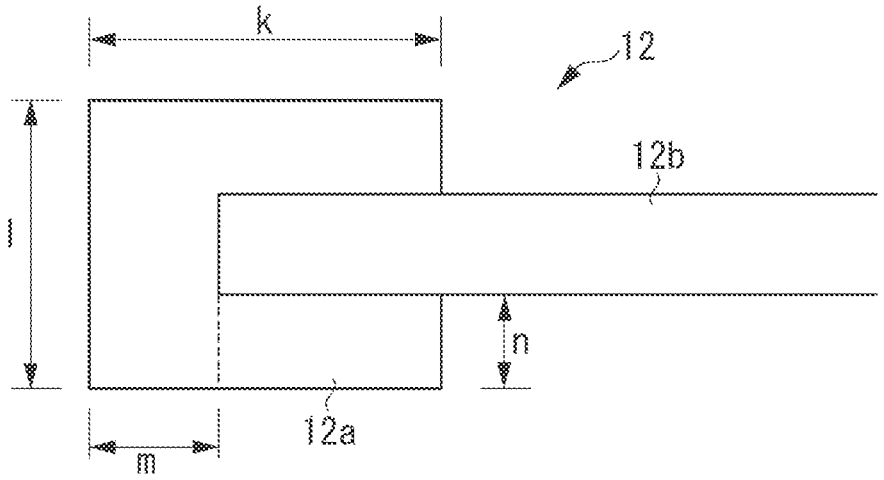
FIG. 3 is a schematic view illustrating a shape of a blade portion in the first exemplary embodiment.

A stainless steel (SUS) plate having a thickness of 0.2 mm is used for the supporting member 12*b*. In addition, a member having a spring characteristic (plate-shaped spring member), for example, a phosphor bronze plate can be used as a blade material. FIG. 3 is a schematic view illustrating a shape of the blade portion 12*a*.

As the rubber member forming the blade portion 12*a*, urethane rubber having a Japan Industrial Standards (JIS) A hardness of 70 degrees is used. The shape of the blade portion 12*a* is as illustrated in FIG. 3. To reduce an effect of deformation of the tip end of the supporting member 12*b*, *k*, *l*, *m*, and n are respectively set to approximately 3.0 mm, 2.0 mm, 1.0 mm, and 1.0 mm. As a method for adhering the supporting member 12*b* and the blade portion 12*a* to each other, a method using a double-sided tape or a hot-melt adhesive is also used in addition to mold forming.

As described above, the other end portion L2 has flexibility with respect to the displacement of the one end portion L1 in the direction of the arrow a illustrated in FIG. 6, so that a contact pressure and a friction force acting on the blade portion 12*a* and the photosensitive drum 1 can be suppressed to a predetermined value or less. When the photosensitive drum 1 is used for a long period of time, a friction coefficient of the surface of the photosensitive drum 1 increases due to scraping by the cleaning blade 12 and adhesion of discharge products by charging. When there is little toner on a contact surface between the cleaning blade 12 and the photosensitive drum 1 at the start of use, there is nothing to function as a lubricant. Thus, friction of the surface of the photosensitive drum 1 increases. When the friction of the surface of the photosensitive drum 1 increases, a friction force and a contact pressure, which act on the contact portion B, received by the blade portion 12*a* during rotation of the photosensitive drum 1 increase. If the other end portion L2 has flexibility with respect to the displacement of the one end portion L1 in the direction of the arrow a, the blade portion 12*a* (the contact portion B) moves away from the photosensitive drum 1 when the blade portion 12*a* receives a force in the direction of the arrow a by the rotation of the photosensitive drum 1. Thus, the one end portion L1 is displaced with the fixed portion A as a supporting point. Thus, a contact pressure and a friction force of the blade portion 12*a* on the photosensitive drum 1 can be suppressed to a predetermined value or less so that the contact pressure of the blade portion 12*a* on the photosensitive drum 1 can be further stabilized.

Figure 9:
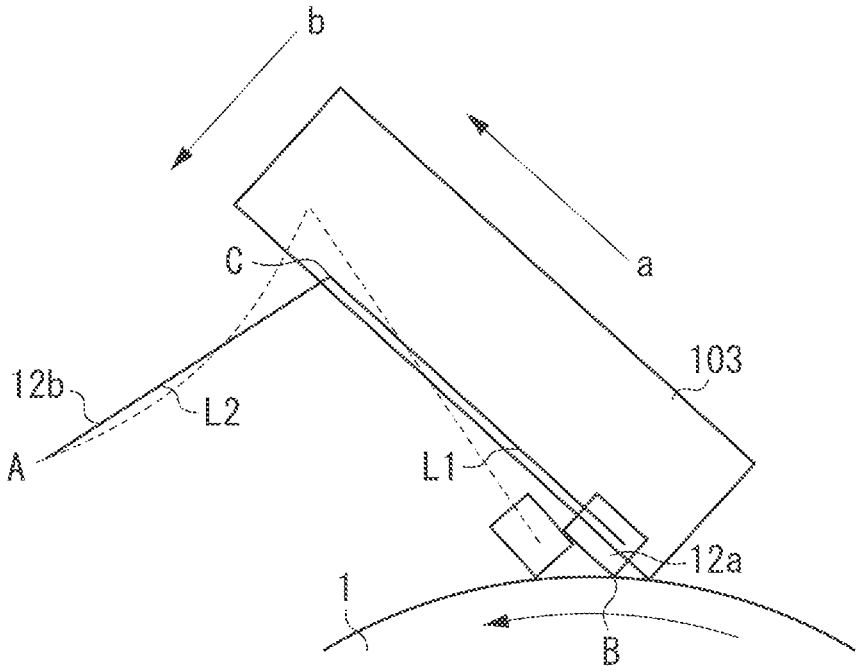
FIG. 9 is a schematic view illustrating a general sealing configuration in which a sealing member is pressed against one end of a supporting member.

As a general sealing configuration (sealing structure), a sealing configuration for preventing leakage of waste toner by pressing a sealing member 103 against an end of a cleaning blade 12 (an end of one end portion L1) is illustrated in FIG. 9. Components illustrated in FIG. 9 are assigned similar reference numerals to those in the present exemplary embodiment for convenience of the description.

In such a sealing configuration, the one end portion L1 is displaced in a direction of an arrow a and a direction of an arrow b illustrated in FIG. 9 as a photosensitive drum 1 rotates so that the a gap is formed between the sealing member 103 and the one end portion L1. Waste toner may easily leak from the gap.

The one end portion L1 is pressed against the sealing member 103 when displaced. Thus, the one end portion L1 receives a force by elasticity of the sealing member 103 in a direction opposite to the displacement of the one end portion L1. This raises concerns that a deformation operation of the one end portion L1 is prevented, the movement of the blade portion 12*a* away from the photosensitive drum 1 is obstructed, and an effect of suppressing increases in an contact pressure and a friction force is reduced.

Figure 1:
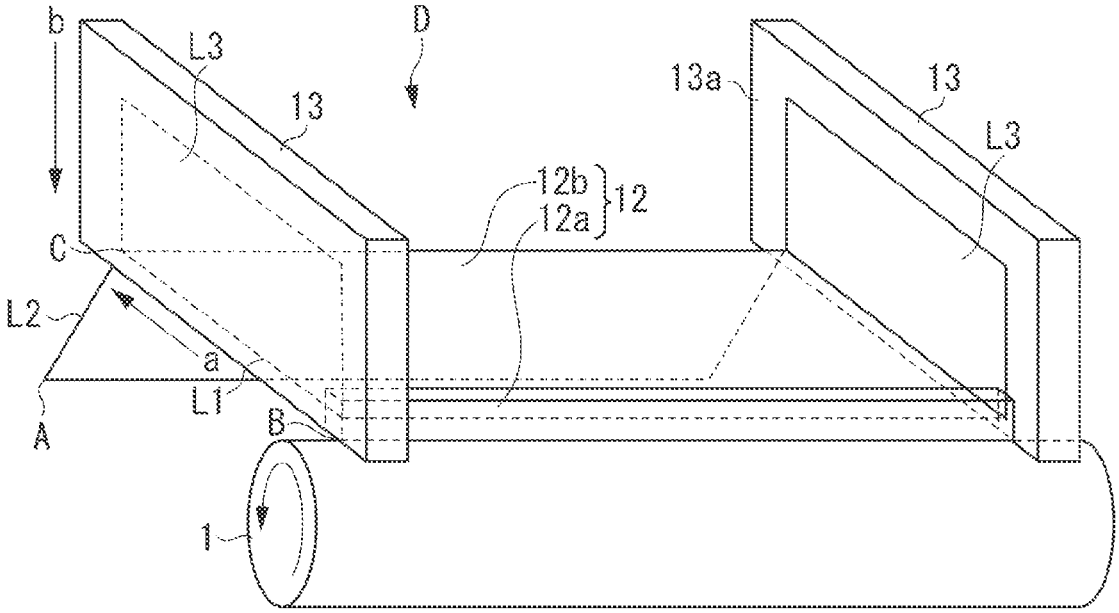
FIG. 1 is a perspective view illustrating a schematic configuration of a main part of a cleaning device according to a first exemplary embodiment.
Figure 4:
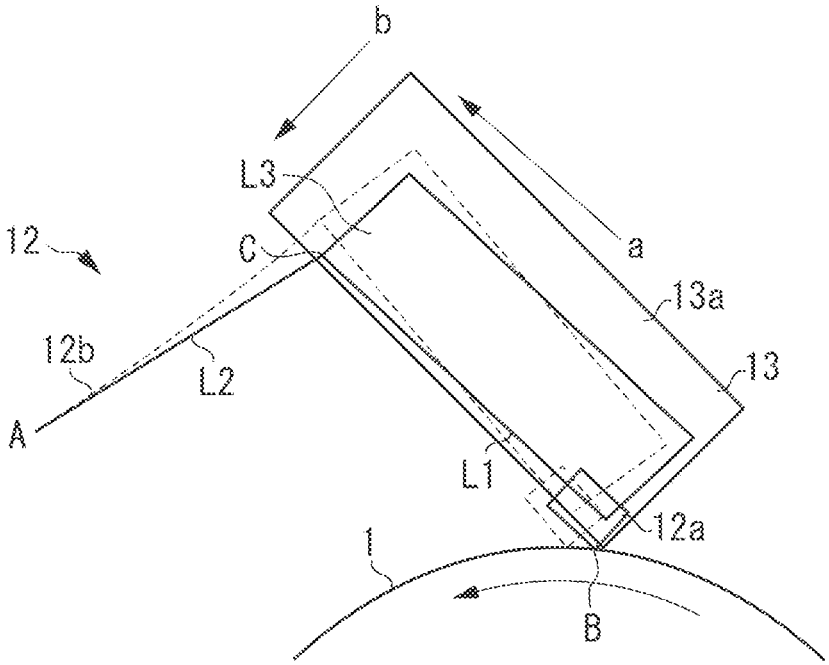
FIG. 4 illustrates a schematic configuration of the main part of the cleaning device according to the first exemplary embodiment.

The cleaning device 11 according to the present exemplary embodiment has a further characteristic configuration, as illustrated in FIGS. 1 and 4. FIG. 1 is a perspective view illustrating a schematic configuration of a main part of the cleaning device 11 according to the present exemplary embodiment. FIG. 4 illustrates a schematic configuration of a main part of the cleaning device 11 according to the present exemplary embodiment.

In the present exemplary embodiment, the cleaning blade 12 includes side plate portions L3 formed by using each end in a longitudinal direction of the one end portion L1 as a folded projection. The side plate portions L3 are respectively provided at both ends in the longitudinal direction of the one end portion L1 (side ends of the one end portion L1) to project toward the housing 14 (toward a frame member) from the one end portion L1. The longitudinal direction is a direction perpendicular to the movement direction of the photosensitive drum 1, i.e., a rotation axis direction of the photosensitive drum 1, on the surface of the photosensitive drum 1.

While the supporting member 12*b* is formed by folding a metal plate spring of one member in the present exemplary embodiment, the present invention is not limited to this. The supporting member 12*b* may be formed of a plurality of members (e.g., a combination of flat plate-shaped members).

In the present exemplary embodiment, the sealing member 13 having a sliding surface 13*a*, which slidably contacts the side plate portion L3, is further provided. In the present exemplary embodiment, the side plate portion L3 and the blade portion 12*a* are provided flush with each other (at substantially the same positions in the longitudinal direction) so that the sealing member 13 slidably contacts each of the ends in the longitudinal direction of the side plate portion L3 and the blade portion 12*a*.

The side plate portion L3 and the blade portion 12*a* may not be arranged flush with each other as long as the ends in the longitudinal direction of the side plate portion L3 and the blade portion 12*a* can be sealed. The configuration is not limited to the case in which the sealing member 13 performs sealing by slidably contacting both the side plate portion L3 and the blade portion 12*a*. The sealing member 13 may slidably contact only the side plate portion L3, and another sealing member may slidably contact the blade portion 12*a*.

The sealing member 13 is fixed to the housing 14, and the sealing member 13 and the side plate portion L3 are disposed to contact each other outside of the housing 14 and overlap each other when viewed from the longitudinal direction. As illustrated in FIG. 4, the sealing member 13 is formed in such a size that the ends in the longitudinal direction of the side plate portion L3 and the blade portion 12*a* slidably contact the sliding surface 13*a* of the sealing member 13 even if the side plate portion L3 is displaced in the directions of the arrow a and the arrow b as the one end portion L1 is displaced. In FIG. 4, the cleaning blade 12 is displaced (moved) from a position indicated by a solid line to a position indicated by a dotted line by being displaced in the directions of the arrow a and the arrow b. While a urethane foam is used as the sealing member 13 in the present exemplary embodiment, the present invention is not limited to this. A material, such as a foam material or a hot-melt adhesive, having elasticity may be used.

The cleaning blade 12 is thus configured so that the sealing member 13 slidably contacts the side plate portion L3 when the one end portion L1 is displaced. Thus, a gap is not formed between the one end portion L1 and the sealing member 13 even if the one end portion L1 is displaced. Therefore, the occurrence of leakage of waste toner can be suppressed.

In the configuration according to the present exemplary embodiment, even if the one end portion L1 is displaced in the directions of the arrow a and the arrow b as the photosensitive drum 1 rotates, the one end portion L1 does not receive a force by elasticity of the sealing member 13 in a direction opposite to the displacement of the one end portion L1, like in a form illustrated in FIG. 9. Therefore, obstruction of the displacement of the one end portion L1 can be suppressed, and sealing performance of the end of the one end portion L1 can be improved while elasticity of the other end portion L2 is maintained.

As described above, according to the present exemplary embodiment, the sealing performance can be improved while the further effect of stabilizing the contact pressure of the blade portion 12*a* on the photosensitive drum 1 can be obtained by suppressing the contact pressure and the friction force of the blade portion 12*a* against the photosensitive drum 1 to a predetermined value or less.

A second exemplary embodiment is described below. In the present exemplary embodiment, different components from those in the first exemplary embodiment will be described, and description of similar components to those in the first exemplary embodiment is not repeated.

Figure 7:
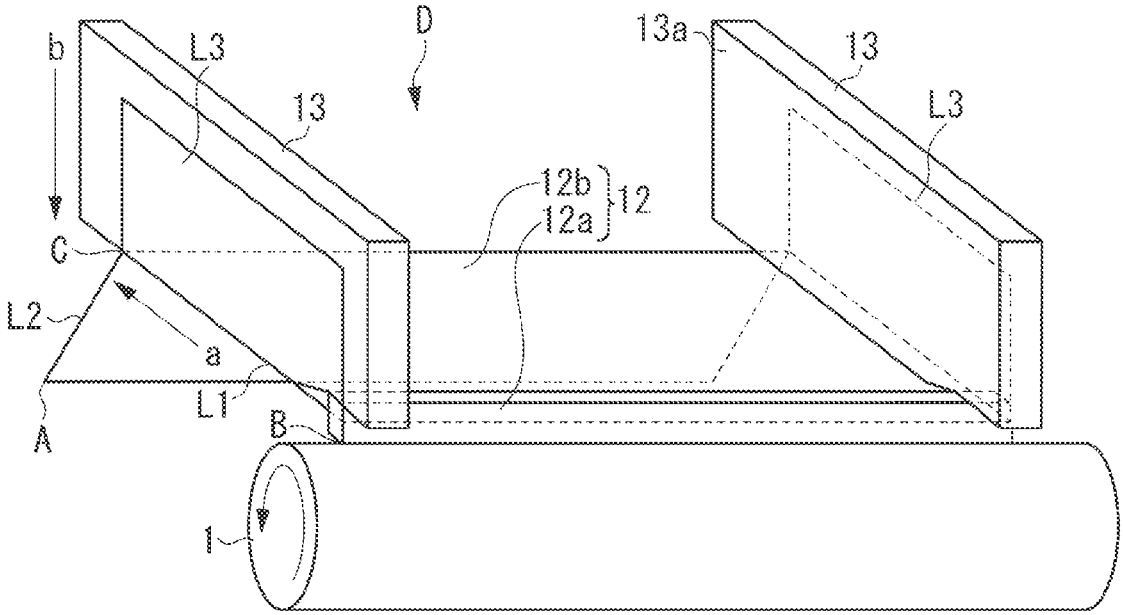
FIG. 7 is a perspective view illustrating a schematic configuration of a main part of a cleaning device according to a second exemplary embodiment.

FIG. 7 is a perspective view illustrating a schematic configuration of a main part of a cleaning device 11 according to the present exemplary embodiment.

While the sealing member 13 is arranged outside the side plate portion L3 (outside the waste toner chamber D) in the first exemplary embodiment, a sealing member 13 is arranged inside a side plate portion L3 (inside a waste toner chamber D) in the present exemplary embodiment.

In the present exemplary embodiment, a housing 14 can be formed by making the width thereof in a longitudinal direction narrower than that in the first exemplary embodiment. Therefore, the housing 14 and the cleaning device 11 can be miniaturized.

Also in the configuration according to the present exemplary embodiment, if one end portion L1 is displaced, the sealing member 13 slidably contacts the side plate portion L3. Even if the one end portion L1 is displaced, therefore, a gap is not formed between the one end portion L1 and the sealing member 13. Thus, the occurrence of leakage of waste toner can be suppressed.

In the present exemplary embodiment, the sealing member 13 is positioned inside the side plate portion L3. Thus, the sealing member 13 and a blade portion 12*a* contact to overlap each other in a radial direction with respect to a rotation axis of a photosensitive drum 1, as illustrated in FIG. 7, so that the sealing member 13 seals an end in the longitudinal direction of the blade portion 12*a*. Therefore, in a state illustrated in FIG. 7 (corresponding to the position indicated by the solid line illustrated in FIG. 4 in the first exemplary embodiment), the sealing member 13 remains crushed (compressed) by the blade portion 12*a*. If the photosensitive drum 1 rotates from this state, the one end portion L1 is displaced so that a crushing margin of the sealing member 13 by the blade portion 12*a* is small. If the one end portion L1 is displaced as the photosensitive drum 1 rotates, therefore, obstruction of the displacement of the one end portion L1, which has been a matter of concern in the form illustrated in FIG. 9, can be suppressed. The sealing member 13 and the blade portion 12*a* may be arranged so that the crushing margin of the sealing member 13 by the blade portion 12*a* does not change if the one end portion L1 is displaced. More specifically, if the one end portion L1 is displaced, the sealing member 13 may seal the end in the longitudinal direction of the blade portion 12*a* by slidably contacting the side plate portion L3 without being pressed by the displaced one end portion L1 (a supporting member 12*b*). Thus, the obstruction of the displacement of the one end portion L1, which has been a matter of concern in the form illustrated in FIG. 9, can be suppressed.

Also in the present exemplary embodiment, the sealing member 13 may slidably contact only the side plate portion L3, to configure a sealing structure by providing another sealing member between the sealing member 13 and the blade portion 12*a* and making the other sealing member slidably contact the blade portion 12*a*.

As described above, in the present exemplary embodiment, a similar effect to that in the above-mentioned first exemplary embodiment can also be obtained. In addition thereto, the reduction in size of the housing 14 and the cleaning device 11 can also be realized in the present exemplary embodiment.

A third exemplary embodiment will be described below. In the present exemplary embodiment, different components from those in the first and second exemplary embodiments will be described, and description of similar components to those in the first and second exemplary embodiments is not repeated.

Figure 8:
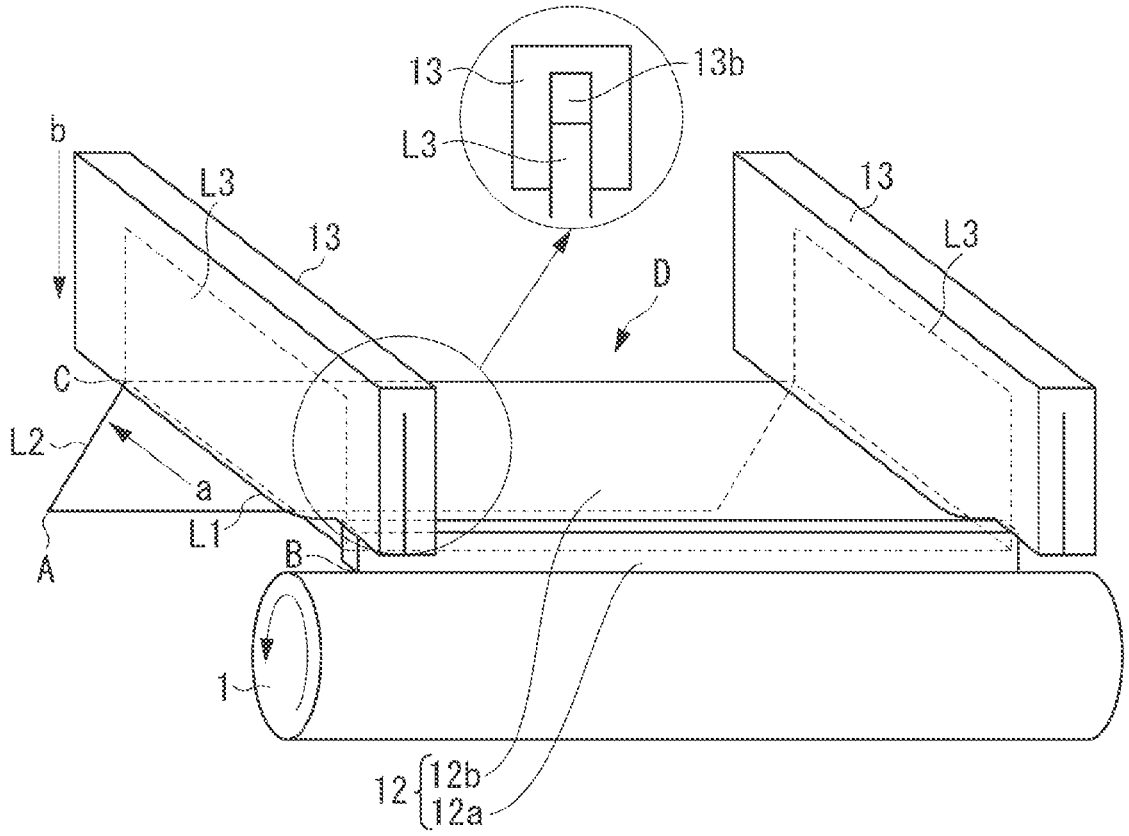
FIG. 8 is a perspective view illustrating a schematic configuration of a main part of a cleaning device according to a third exemplary embodiment.

FIG. 8 is a perspective view illustrating a schematic configuration of a main part of a cleaning device 11 according to the present exemplary embodiment.

In the present exemplary embodiment, a sealing member 13 has a slit (groove) 13*b* into which a side plate portion L3 is inserted.

While the sealing member 13 contacts only one surface of the side plate portion L3, as illustrated in FIG. 1, in the first exemplary embodiment, both surfaces of the sealing member 13 contacts the side plate portion L3, as illustrated in FIG. 8, in the present exemplary embodiment. Thus, waste toner sealing performance in the present exemplary embodiment is more improved than that in the first exemplary embodiment.

In the present exemplary embodiment, a slit 13*b* is sufficiently deep so that the side plate portion L3 does not come into contact with the bottom of the slit 13*b* even if the side plate portion L3 is displaced in a direction of an arrow a. Consequently, even if one end portion L1 is displaced as a photosensitive drum 1 rotates, the side plate portion L3 is not pressed against the bottom of the slit 13*b*. Therefore, the displacement of the one end portion L1 is prevented from being obstructed by arranging the side plate portion L3 in the slit 13*b*.

Also in the present exemplary embodiment, the sealing member 13 is made to contact the side plate portion L3 and a blade portion 12*a* to seal an end in a longitudinal direction of the blade portion 12*a*, like in the second exemplary embodiment. The sealing of the end in the longitudinal direction of the blade portion 12*a* has been described in the second exemplary embodiment.

As described above, according to the present exemplary embodiment, a similar effect to that in the first exemplary embodiment can also be obtained. In the present exemplary embodiment, the sealing performance can be improved more than that in the first exemplary embodiment.

While the sealing member 13 is fixed to the housing 14 in the above-mentioned first to third exemplary embodiments, the present invention is not limited to this. The sealing member 13 may be fixed to the side plate portion L3 and slidably contact the housing 14. More specifically, the sealing member 13 may be fixed to either one of the side plate portion L3 and the housing 14 and slidably contact the other. This also realizes a sealing structure for sealing between the cleaning blade 12 and the housing 14.

The present invention is not limited to the above-mentioned image forming apparatus illustrated in FIG. 5. The present invention is also appropriately applicable in an intermediate transfer type image forming apparatus using an intermediate transfer belt (intermediate transfer member) and an image forming apparatus of a type for transferring a toner image onto a sheet material carried and conveyed on a conveyance belt (conveyance member). In the image forming apparatuses, the present invention is appropriately applicable as not only a cleaning device for a photosensitive drum but also a cleaning device for cleaning toner that has adhered to a surface of the intermediate transfer belt or the conveyance belt. The present invention is not limited to an image forming apparatus capable of forming an image in a single color. The present invention is appropriately applicable even in an image forming apparatus capable of forming an image in a plurality of colors (a color image).

According to the present invention, a contact pressure of a blade portion on a member to be cleaned can be more stabilized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-039528 filed Feb. 28, 2013, which is hereby incorporated by reference herein in its entirety.

What is claimed is:

1. A cleaning device for an image forming apparatus, comprising:

(i) a frame member;

(ii) a cleaning member for removing a developer from a surface of a member to be cleaned , the cleaning member including a blade portion configure to come into contact with the member to be cleaned in a direction counter to a moving direction of the member to be cleaned; and a flexible plate-like supporting member configured to support the blade portion, the supporting member including one end portion, in which the blade portion is provided, the other end portion, which has a portion to be fixed to the frame member, a bent portion, which is positioned between the one end portion and the other end portion and positioned outwardly away from the surface of the member to be cleaned with respect to a line segment connecting the portion to be fixed and a contact portion, in which the blade portion comes into contact with the member to be cleaned, and a side plate portion projecting from a side end of the one end portion, wherein the portion to be fixed is arranged on the downstream side of the moving direction of the member to be cleaned to the contact portion;

(iii) a storage chamber, which includes the frame member, configured to store the developer removed by the cleaning member; and (iv) a sealing member, which is provided between the cleaning member and the frame member, configured to prevent the developer from leaking from the storage chamber and fixed to one of the side plate portion and the frame member.

2. The cleaning device according to claim 1, wherein the side plate portion is formed by folding the one end portion.

3. The cleaning device according to claim 1, wherein the sealing member comes into contact with an end in a longitudinal direction of the blade portion.

4. The cleaning device according to claim 1, wherein the sealing member is fixed to an outside surface of the side plate portion in a longitudinal direction of the blade portion.

5. The cleaning device according to claim 1, wherein the sealing member is fixed to the frame member to slide with the outside surface of the side plate portion in a longitudinal direction of the blade portion.

6. The cleaning device according to claim 1, wherein the sealing member is fixed to an inside surface of the side plate portion in a longitudinal direction of the blade portion.

7. The cleaning device according to claim 1, wherein the sealing member is fixed to the frame member to slide with the inside surface of the side plate portion in a longitudinal direction of the blade portion.

8. The cleaning device according to claim 1, wherein the sealing member is fixed over the inside surface and the outside surface of the side plate portion in a longitudinal direction of the blade portion.

9. The cleaning device according to claim 1, wherein the supporting member is a metal plate spring.

10. A process cartridge attachable to and detachable from an image forming apparatus, the process cartridge comprising:

(i) a photosensitive member;

(ii) a frame member;

(iii) a cleaning member for removing a developer from a surface of the photosensitive member, the cleaning member including a blade portion configured to come into contact with the photosensitive member in a direction counter to a moving direction of the photosensitive member; and a flexible plate-like supporting member configured to support the blade portion, the supporting member including one end portion, in which the blade portion is provided, the other end portion, which has a portion to be fixed to the frame member, a bent portion, which is positioned between the one end portion and the other end portion and positioned outwardly away from the surface of the photosensitive member with respect to a line segment connecting the portion to be fixed and a contact portion, in which the blade portion comes into contact with the photosensitive member, and a side plate portion projecting from a side end of the one end portion, wherein the portion to be fixed is arranged on the downstream side of the moving direction of the photosensitive member to the contact portion;

(iv) a storage chamber, which includes the frame member, configured to store the developer removed by the cleaning member; and (v) a sealing member, which is provided between the cleaning member and the frame member, configured to prevent the developer from leaking from the storage chamber and fixed to one of the side plate portion and the frame member.

11. The process cartridge according to claim 10, wherein the side plate portion is formed by folding the one end portion.

12. The process cartridge according to claim 10, wherein the sealing member comes into contact with an end in a longitudinal direction of the blade portion.

13. The process cartridge according to claim 10, wherein the sealing member is fixed to an outside surface of the side plate portion in a longitudinal direction of the blade portion.

14. The process cartridge according to claim 10, wherein the sealing member is fixed to the frame member to slide with the outside surface of the side plate portion in a longitudinal direction of the blade portion.

15. The process cartridge according to claim 10, wherein the sealing member is fixed to an inside surface of the side plate portion in a longitudinal direction of the blade portion.

16. The process cartridge according to claim 10, wherein the sealing member is fixed to the frame member to slide with the inside surface of the side plate portion in a longitudinal direction of the blade portion.

17. The process cartridge according to claim 10, wherein the sealing member is fixed over the inside surface and the outside surface of the side plate portion in a longitudinal direction of the blade portion.

18. The process cartridge according to claim 10, wherein the supporting member is a metal plate spring.

19. An image forming apparatus for forming an image on a recording medium, the image forming apparatus comprising:

(i) a member to be cleaned;

(ii) a frame member;

(iii) a cleaning member for removing a developer from a surface of the member to be cleaned, the cleaning member including a blade portion configured to come into contact with the member to be cleaned in a direction counter to a moving direction of the member to be cleaned; and a flexible plate-like supporting member configured to support the blade portion, the supporting member including one end portion, in which the blade portion is provided, the other end portion, which has a portion to be fixed to the frame member, a bent portion, which is positioned between the one end portion and the other end portion and positioned outwardly away from the surface of the member to be cleaned with respect to a line segment connecting the portion to be fixed and a contact portion, in which the blade portion comes into contact with the member to be cleaned, and a side plate portion projecting from a side end of the one end portion, wherein the portion to be fixed is arranged on the downstream side of the moving direction of the member to be cleaned to the contact portion;

(iv) a storage chamber, which includes the frame member, configured to store the developer removed by the cleaning member; and (v) a sealing member, which is provided between the cleaning member and the frame member, configured to prevent the developer from leaking from the storage chamber and fixed to one of the side plate portion and the frame member.

20. The image forming apparatus according to claim 19, wherein the side plate portion is formed by folding the one end portion.

21. The image forming apparatus according to claim 19, wherein the sealing member comes into contact with an end in a longitudinal direction of the blade portion.

22. The image forming apparatus according to claim 19, wherein the sealing member is fixed to an outside surface of the side plate portion in a longitudinal direction of the blade portion.

23. The image forming apparatus according to claim 19, wherein the sealing member is fixed to the frame member to slide with the outside surface of the side plate portion in a longitudinal direction of the blade portion.

24. The image forming apparatus according to claim 19 wherein the sealing member is fixed to an inside surface of the side plate portion in a longitudinal direction of the blade portion.

25. The image forming apparatus according to claim 19, wherein the sealing member is fixed to the frame member to slide with the inside surface of the side plate portion in a longitudinal direction of the blade portion.

26. The image forming apparatus according to claim 19, wherein the sealing member is fixed over the inside surface and the outside surface of the side plate portion in a longitudinal direction of the blade portion.

27. The image forming apparatus according to claim 19, wherein the supporting member is a metal plate spring.

28. The image forming apparatus according to claim 19, wherein the member to be cleaned is a photosensitive member on which a development image is formed.

29. The image forming apparatus according to claim 19, wherein the member to be cleaned is an intermediate transfer member onto which a development image is transferred.

30. The image forming apparatus according to claim 19, wherein the member to be cleaned is a conveyance member for conveying a recording medium.

31. A cleaning device for an image forming apparatus, comprising:

(i) a frame member;

(ii) a cleaning member for removing a developer from a surface of a member to be cleaned , the cleaning member including a blade portion configure to come into contact with the member to be cleaned; and a plate-like supporting member configured to support the blade portion, the supporting member including (a) one end portion in which the blade portion is provided, (b) the other end portion which has a portion to be fixed to the frame member, (c) a bent portion which is positioned between the one end portion and the other end portion and (d) a side plate portion projecting from a side end of the one end portion, (iii) a storage chamber configured to store the developer removed by the cleaning member; and (iv) a sealing member, which is provided between the cleaning member and the frame member, configured to prevent the developer from leaking from the storage chamber and fixed to one of the side plate portion and the frame member.

32. The cleaning device according to claim 31, wherein the portion to be fixed is arranged on the downstream side of the moving direction of the member to be cleaned to the contact portion.

33. The cleaning device according to claim 31, wherein the bent portion is positioned outwardly away from the surface of the member to be cleaned.

* * * * *